US007033116B1

(12) United States Patent
Ward et al.

(10) Patent No.: US 7,033,116 B1
(45) Date of Patent: Apr. 25, 2006

(54) POST-TENSIONED RAMMED EARTH CONSTRUCTION

(76) Inventors: Thomas Ward, 200 E. Broadway, Jackson, WY (US) 83002; Joseph Grill, 2220 Sky Dr., Clarkdale, AZ (US) 86324

( * ) Notice: Subject to any disclaimer, the term of this patent is extended or adjusted under 35 U.S.C. 154(b) by 0 days.

(21) Appl. No.: 11/221,090

(22) Filed: Sep. 6, 2005

Related U.S. Application Data

(60) Provisional application No. 60/607,117, filed on Sep. 3, 2004.

(51) Int. Cl.
*E02D 27/00* (2006.01)

(52) U.S. Cl. ..... 405/229; 405/271; 52/293.3; 52/742.14

(58) Field of Classification Search ..... 52/293.3, 52/295, 742.14, 742.15; 405/229, 271
See application file for complete search history.

(56) References Cited

U.S. PATENT DOCUMENTS

| | | | | |
|---|---|---|---|---|
| 859,663 | A | 7/1907 | Jackson | |
| 1,655,676 | A * | 1/1928 | Daggett | 52/169.1 |
| 2,388,679 | A | 11/1945 | Davis | |
| 2,400,852 | A | 5/1946 | Stevenson | |
| 3,643,390 | A | 2/1972 | Shelley | |
| 4,161,852 | A | 7/1979 | Schultz | |
| 4,225,359 | A | 9/1980 | Schneider | |
| 4,366,657 | A | 1/1983 | Hopman | |
| 4,452,028 | A * | 6/1984 | Norton et al. | 52/742.14 |
| 4,726,567 | A | 2/1988 | Greenberg | |
| 5,021,202 | A | 6/1991 | Novotny | |
| 5,029,804 | A | 7/1991 | McGregor | |
| 5,138,808 | A | 8/1992 | Bengtson et al. | |
| 5,851,567 | A | 12/1998 | Proni | |
| 6,119,426 | A | 9/2000 | Escudero | |

(Continued)

FOREIGN PATENT DOCUMENTS

| | | |
|---|---|---|
| WO | WO-88/02802 | 4/1988 |

OTHER PUBLICATIONS

"Earth Materials Guidelines", http://www.greenbuilder.com.
"Important Facts About Stabilized Earth", http://www.rammedearthworks.com.
"Rammed Earth Constructions: Transcultural Research in the Sonoran Desert", http://ag.arizona.edu.

(Continued)

*Primary Examiner*—Frederick L. Lagman
(74) *Attorney, Agent, or Firm*—Rod D. Baker; Peacock Myers, P.C.

(57) ABSTRACT

A method for erecting structures composed of rammed-earth. A method of rammed-earth building construction is disclosed wherein walls are post-tensioned to enhance the ability of the wall to receive lateral loading without failing in tension.

Post-tensioning rods are anchored to a concrete footing, and temporary forms erected alongside the footing. A protective sleeve is disposed around each post-tensioning rod. An earthen mixture is placed between the forms and around the sleeves, and rammed by compaction in a series of stacked courses. When the rammed-earth wall has obtained the desired height, it is topped with a concrete bond beam through which the post-tensioning rods extend. Using the bond beam as a brace against which a retaining plate may push, retaining plates are disposed upon the bond beam and around the threaded upper ends of each rod. A nut is threaded upon each rod and tightened against the retaining plate to draw the rod into tension. The torque applied to the nut thus loads the wall in compression via the plates and bond beam. Thus compressed, the rammed-earth wall is less susceptible to tension failure.

20 Claims, 7 Drawing Sheets

U.S. PATENT DOCUMENTS

| | | | | |
|---|---|---|---|---|
| 6,347,931 | B1 | 2/2002 | Underwood | |
| 6,547,483 | B1 | 4/2003 | Rae-Smith | |
| 6,718,722 | B1 * | 4/2004 | Worrell et al. | 52/741.13 |
| 6,739,102 | B1 * | 5/2004 | Roy, Sr. | 52/295 |
| 2002/0021936 | A1 | 2/2002 | Rae-Smith | |

OTHER PUBLICATIONS

McHenry, Jr., Paul G., "Adobe and Rammed Earth Buildings—Design and Construction", *University of Arizona Press, 4th ptg. 1989.*

* cited by examiner

POST-TENSIONED RAMMED EARTH CONSTRUCTION

CROSS-REFERENCE TO RELATED APPLICATIONS

This application claims the benefit of the filing of U.S. Provisional Patent Application Ser. No. 60/607,117 entitled "Post-tensioned Rammed Earth Construction," filed on Sep. 3, 2004, and the entire specification thereof is incorporated herein by reference.

BACKGROUND OF THE INVENTION

1. Field of the Invention (Technical Field)

The present invention relates to construction methods and materials, generally to methods and materials for constructing buildings, particularly rammed-earth construction, and specifically to a method for erecting post-tensioned rammed earth structures.

2. Background Art

Mankind for millennia has been erecting buildings made from earth, such as mud, sod, and adobe brick. A somewhat more sophisticated, but long-known, method for using earth as a building material is rammed-earth construction, involving the packing of a soil-cement mixture into forms (often wood framed formworks). Ordinary rammed earth structures, however, are vulnerable to certain types loading, particularly the stresses induced by earthquakes and high winds. The present invention is an advance in the art of rammed-earth construction, devised to overcome its observed vulnerabilities.

Conventional rammed-earth construction methods typically involve the erection of parallel vertical forms that are maintained in spaced-apart relation and exteriorly supported. The forms support the wall during its construction. For example, planar forms are known which may be oriented vertically with their generally smooth interior faces in confronting relation, but separated by a predetermined distance. The spaced relation of the forms is maintained during construction by a variety of known types of spacers or "ties," which extend between the vertical forms and prevent them from moving toward each other any substantial distance less than the predetermined lateral thickness of the wall. Also, the forms normally feature horizontal and vertical reinforcing ribs on their exterior faces to provide structural integrity. The forms are exteriorly supported to prevent them from moving away from each other any substantial distance greater than the predetermined thickness of the wall. The art of form construction in this regard is well known, and form erection methods for rammed-earth construction may borrow from processes and devices long used in the art of concrete construction.

Rammed earth construction, known generally for centuries and increasing once again in popularity as the cost of other types of construction materials and methods rise, is not without problems. The present invention is directed to increasing the ability for rammed-earth building elements, particularly walls, to withstand shear forces that otherwise result in structural failure.

One of the most important questions pertaining to rammed earth construction is its response to earthquakes and high winds. There are currently a variety of different design approaches employed, depending on the seismic zone in which the structure is to be located. For instance, one method employs individual panels of earth that are encased within a skeleton of cast-in-place concrete. Another method uses a continuous solid earth wall crowned with a beam of reinforced concrete. It also has been attempted to reinforce walls with an ordinary unstressed grid of steel reinforcing bars.

Although these solutions may improve the integrity of the walls in seismic zones, they still leave much to be desired. These solutions are not the most efficient and economical use of rammed-earth construction. For example, installation of a traditional grid of reinforcing steel can dramatically slow the erection of a wall. Further, corrosion of steel rebar in an earth wall is a very real potential problem. The pH level of concrete is much higher than that of soil; the lower pH of many soils can lead to corrosion of steel rebar, especially if the soil has a high moisture content (which is the case in humid climates). If steel reinforcing corrodes and becomes inadequate, an earthen wall may fail without any warning under intermittent loading. Potential corrosion of steel rebar thus becomes an important factor to consider when dealing with earthen construction.

Many modern structures are erected in the shape of a full or partial box to improve their resistance to lateral loading—one of the more destructive kinds of loading inflicted by an earthquake. Box structures may be analyzed by components, based on the components' respective contributions to the lateral load resistance of the building. The movement of the ground during an earthquake delivers forces to the building, which are initially applied to the footings or foundation, and then promptly transmitted to the walls and roof. For simplicity of discussion here, it may be generally assumed that the structural loads act either perpendicular or parallel to the walls. The earthquake load is transferred from the floor or roof diaphragms (the diaphragms are merely the floor or roof structures) to the shear walls. "Shear walls" are those walls oriented roughly parallel to the vector of the earthquake force (i.e., the direction of building movement). More technically, any wall that is not perpendicular to the earthquake force vector will receive some component of applied force; the more parallel the wall is to the imposed force, the greater the shear force it must withstand.

In order for the structural box system to stand up to an earthquake or high wind, the floor and/or roof must be well-connected to the walls. If not, the structure may become unstable and collapse during motion. In addition, each wall, floor or roof element must have enough strength to transfer the load it receives; each element is like a link in a chain—if any link breaks, the entire chain fails. "Flexural walls" are those walls generally perpendicular to the direction of motion in an earthquake or wind. Ideally, these walls "lean" on the diaphragm elements during ground motion, thus preventing the walls from falling inward or outward. Flexural walls, if unsound, also may fail, particularly if unable to withstand the tensions that a created in the "bowing" wall.

Rammed earth structures act like such a box structure during an earthquake. Flexural walls bend "out-of-plane" and shear walls bend "in-plane." To maintain structural stability, the walls must be of adequate strength to carry the inertial forces developed as a result of their own mass, in addition to the externally applied loads. Further, the walls must be adequately interconnected. Rammed-earth walls erected according to simple convention are mostly unable to withstand tensile stresses, compromising their ability to accept loading during strong wind or earthquake. An unreinforced rammed earth wall undergoing flexure or shear stress tends to fail due to its inability to transmit tensile stresses. The present methodology is directed to solving this latter problem, among others.

Additional background information on the art of rammed earth construction generally can be obtained from Paul Graham McHenry, Jr., *Adobe and Rammed Earth Buildings—Design and Construction*, (University of Arizona Press, 4th ptg. 1989), which is incorporated herein by reference. Also useful is information found at the following websites on the World Wide Web: "Important Facts About Stabilized Earth," http://www.rammedearthworks.com; "Earth Materials Guidelines," http://www.greenbuilder.com; and "Rammed Earth Constructions: Transcultural Research in the Sonoran Desert," http://ag.arizona.edu. Reference also may be had to U.S. Pat. No. 5,021,202 to Novotny, entitled "Method and Apparatus for Constructing Rammed Earth Walls with Integral Cement Jackets."

SUMMARY OF THE INVENTION (DISCLOSURE OF THE INVENTION)

This disclosure has to do with rammed-earth construction techniques, whereby building walls are erected by pounding a special soil into forms. The invention combines rammed-earth construction techniques with post-tensioning techniques to produce rammed-earth building elements that are earthquake-resistant. Rods or cables are situated through the rammed-earth wall, and then a tension is applied thereto after the wall is completed. The tensioning rods or cables are disposed in conduits for protection and to prevent bonding between the tensioning rods or cables and the rammed earth material.

Thus, there is a disclosed method and apparatuses for erecting structures composed of rammed-earth. A method of rammed-earth building construction is disclosed wherein walls are post-tensioned to enhance the ability of the wall to receive lateral loading without failing in tension.

Post-tensioning rods are anchored to a concrete footing, and temporary forms erected alongside the footing. A protective sleeve is disposed around each post-tensioning rod. An earthen mixture is placed between the forms and around the sleeves, and rammed by compaction in a series of stacked courses. When the rammed-earth wall has obtained the desired height, it is topped with a concrete bond beam through which the post-tensioning rods extend. Using the bond beam as a brace against which a retaining plate may push, retaining plates are disposed upon the bond beam and around the threaded upper ends of each rod. A nut is threaded upon each rod and tightened against the retaining plate to draw the rod into tension. The torque applied to the nut thus loads the wall in compression via the plates and bond beam. Thus compressed, the rammed-earth wall is less susceptible to tension failure.

A primary object of the present invention is to establish a structural wall system that can be used in areas that experience high winds or moderate earthquakes. Furthermore, this wall system requires a minimum quantity of manufactured materials (cement, post-tensioning hardware) in combination with locally available earth, for creating a convenient construction method for use in remote areas or in countries that have insufficient access to quantities of conventional modern construction materials. Additionally, rammed-earth construction according to the present invention can be tailored to local availability of mechanized construction equipment. The system can be constructed using almost entirely human labor, if needed, without the requirement for expensive and heavy construction equipment.

In the invention, post-tensioning technology is used in the erection of rammed-earth walls. The use of rammed-earth construction in higher seismic zones necessitates the addition of a quantity of steel reinforcing. Construction of rammed-earth walls is, however, hampered by the presence of reinforcing steel. In addition, placement and proper compaction of the cement-soil mixture can be compromised by the presence of steel reinforcing rods. Nevertheless, the present invention offers the advantage of permitting the erection of pre-tensioned rammed-earth walls in high wind or seismically active locales.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
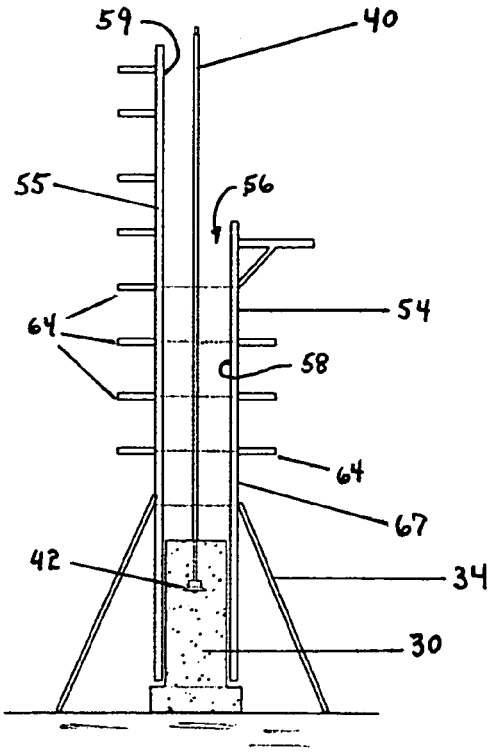
FIG. 1 is a right side or end sectional view of a formwork and footing according to the practice of this disclosure, showing a post tension bar installed vertically between the forms and anchored in the footing.

DESCRIPTION OF THE PREFERRED EMBODIMENTS (BEST MODES FOR CARRYING OUT THE INVENTION)

Earth has been the most extensively used building material in the world since the commencement of recorded history. It has been used for thousands of years because it met the criteria of comfort and efficiency as well as being readily available nearly anywhere in the world. Probably the most prevalent form of earth construction is adobe, in which moistened earthen mixtures, typically including straw, is pressed into brick molds and allowed to dry. The cured bricks are then stacked in courses, sometimes using mud mortar, and the resulting wall then covered with a mud plaster.

Rammed earth construction is the modern form of adobe construction. The technique involves compacting a soil-cement mixture into wooden forms. When the forms are removed solid earth walls 18 to 24 inches thick are left standing. The earth used for the construction of the walls is screened, engineered soil, which is mixed with about 8% water and approximately 3% to about 10% Portland cement. This mixture is placed into the forms in successive courses and tamped. For example, the mixture is placed between the forms in a layer about 8 inches thick, which is compacted into a layer about 5 inches thick. These placement-compaction steps are repeated one above the other until the desired wall height is achieved. The final density of the wall may be, for example, about 125 pounds per cubic foot.

One benefit of rammed-earth construction is its thermal resistivity. Solid earth walls have the ability to store thermal energy for extended periods. This offers small variances in temperature in the building interior from day to night. During winter months, these walls have large mass that absorb solar energy during the day and re-radiate the energy during the night to offset heat losses in the building interior. In the summertime, the walls absorb excess heat produced inside the building during the day, thus cooling the interior, and then release excess heat to the outdoors during the night. Significant savings in heating and cooling costs thus may be realized in a properly designed and oriented building.

Another advantage of rammed-earth construction is its durability and resistance to deterioration. Structures of raw earth built hundreds of years ago in various places around the world have continued to provide shelter throughout the years and are still standing today.

More recently, environmental considerations have provided incentives to erect earthen structures. Soil is an unprocessed, widely available building material. It has nearly no environment side effects associated with its collection or use. This type of construction is a wise choice since earthen building saves construction and energy resources, does not pollute, and has appreciable durability.

Rammed earth construction has a variety of benefits for residential construction. This type of construction is versatile, which makes it advantageous on a world-wide scale. It may also prove to be the most economical and efficient building mode, especially for "Third World" residential housing. For Third World countries, the materials needed for rammed earth are readily available, and the erection technology is relatively simple. This may be ideal for these Third World countries and may be a significant advancement for their people, providing adequate shelter for homes and small public buildings.

Attention is invited to FIG. 1, showing a cross section of a wall element according to the present method, before any rammed earth mixture has been placed. A footing 30 is laid by generally known processes. The footing 30 preferably is fashioned of reinforced concrete, and may be disposed at or below grade at the job site. A reinforced concrete footing 30 is poured into forms constructed for that purpose as known in the art, and allowed to cure.

Some of the means for post-tensioning the rammed earth wall is provided for at the time the footing 30 is laid. There is provided at least one, and preferably a plurality, of tension rods 40 for applying compression forces to the rammed earth wall prior to its erection. The tension rods may be standard tension rods borrowed from the art of post- or pre-stressed reinforced concrete, or may be customized for use with rammed earth. The tension rods 40 preferably are fashioned from steel, and may in part comprise steel rebar. The tension rods 40 may be, for example, from about ¼ inch to about ¾ inch in diameter, depending upon the application.

Each tension bar 40 is oriented vertically for disposition within the rammed earth wall. As seen in FIG. 1, the lowermost end or portion of each tension bar 40 is fitted with a retainer cap 42 (or alternatively a bottom retainer plate as seen in FIG. 3B) secured to the bar 40. The cap 42 is manufactured from durable metal or plastic, and is locked in place upon the tension bar 40 so as to be immobile longitudinally thereon.

Figure 2:
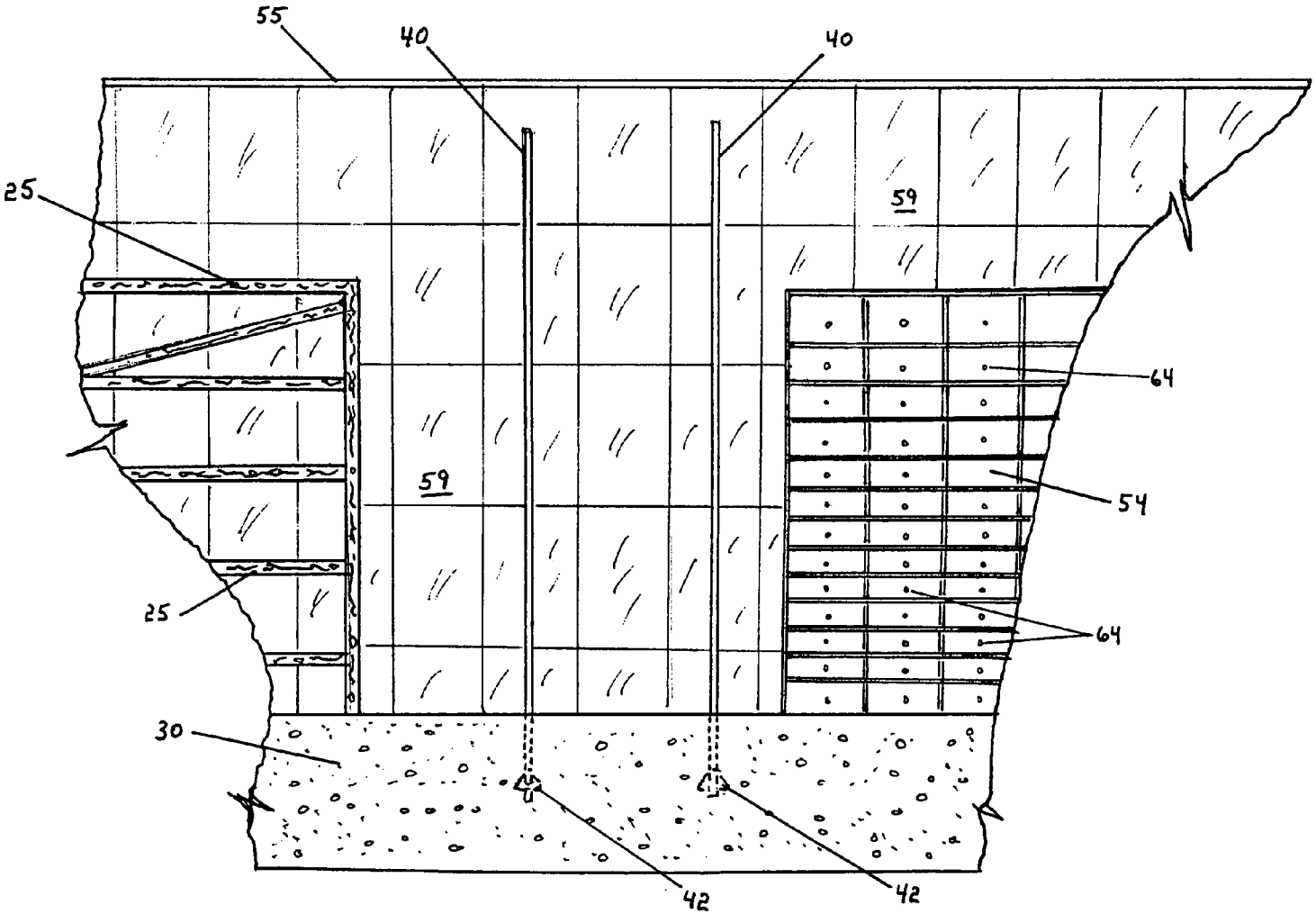
FIG. 2 is a front view, in partial section, of a portion of a framework and footing generally as seen in FIG. 1, showing two post tension bars installed vertically and anchored in the footing, and other apparatus of this specification.
Figure 7:
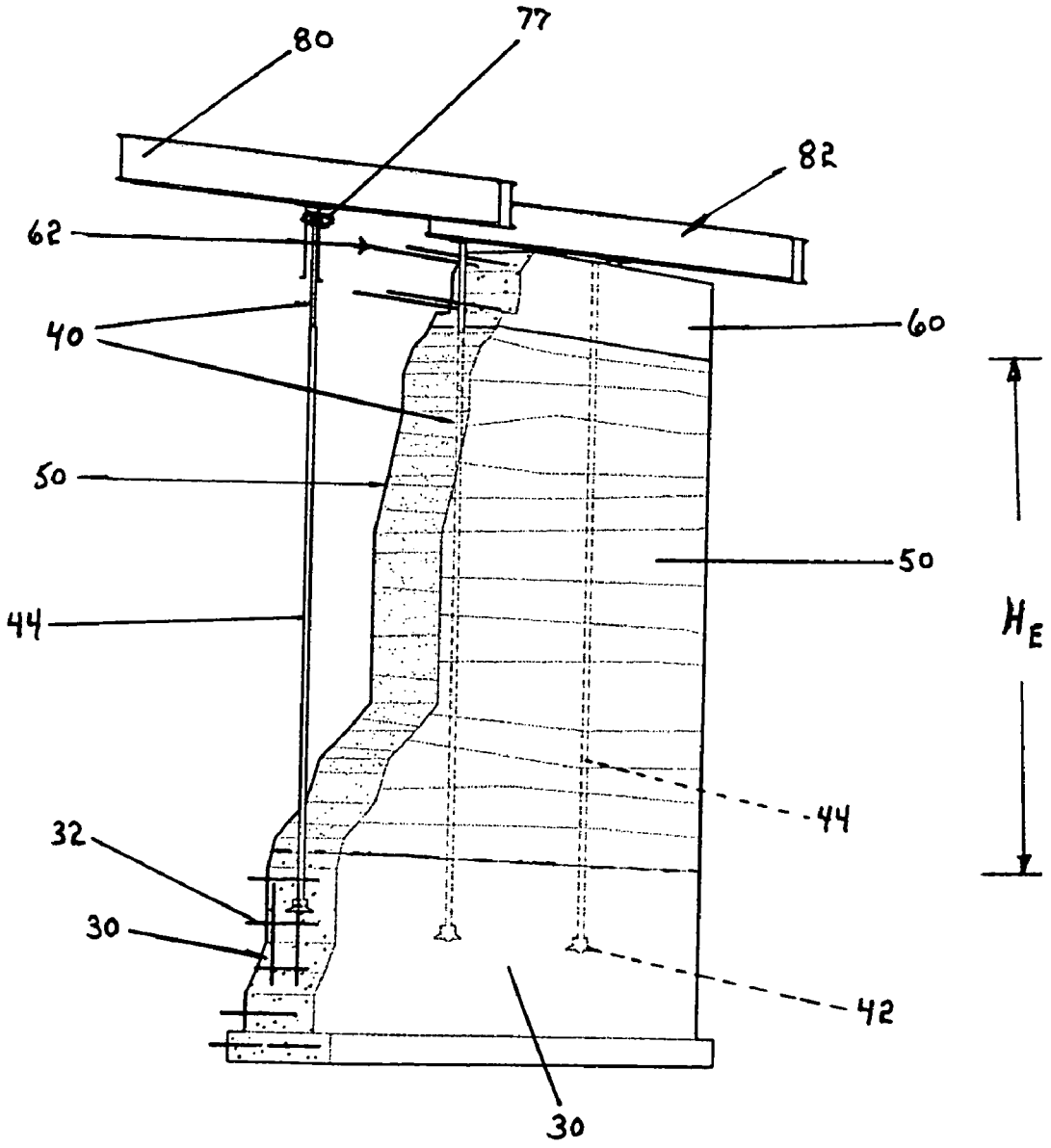
FIG. 7 is a sectional view, in perspective, of a completed wall according to the present invention.

Referring also to FIG. 2, the tension bars 40 are arranged vertically in horizontally spaced positions along the length of a wall to be erected. The distance between adjacent rods 40 is determined from engineering calculations familiar to those of ordinary skill in the art of structural design. It is important to anchor the lower end of each tension rod 40 to the footing 30. This is accomplished preferably by laying and curing the footing with the rods 40 in place with their lower ends encased within the footing itself, as seen in FIGS. 1 and 2. The lower end segments of the tension bars 40 are located during the pouring of the footing 30 such that the lower end segment of each bar is submerged in the wet concrete; the concrete cures with the bars 40 in place within the footing as seen in FIGS. 1, 2 and 7. The distance the lower end of each bar 40 is set into the footing 30 is determined by known structural engineering, based on the stress analysis for the application. The retainer cap 42 increases the resistance of the tension bar 40 against being pulled vertically out of the footing 30. The vertical length of the tension bars 40 arranged along the horizontal extent of a wall is selected to be at least as long as the desired height of the wall to be erected, preferably with a few excess inches of tension bar length to spare.

Continued reference is made to FIGS. 1 and 2. A pair of forms 54, 55 are arranged substantially vertically on the footing 30, the forms being placed in spaced-apart relation to define a form space 56 there-between. Forms 54, 55 are used to support and contain the rammed earth mixture, and a concrete beam thereon, during erection of the wall. A person of ordinary skill will appreciate that the same forms 54, 55 used to contain the rammed earth mixture optionally also may be used to form the vertical sides of the footing 30, depending upon footing design and form materials availability. The forms 54, 55 are substantially similar in configuration and material composition to the forms and forming systems utilized in the art of concrete engineering and construction.

As bees seen in FIG. 1, a form 54 or 55 is erected on each side of the footing 30. The forms 54, 55 have generally parallel inner planar faces 58, 59 separated by a predetermined distance corresponding to the desired lateral thickness of the wall. The parallel forms 54, 55 are interconnected with a multitude of spacer components 64 that hold the forms in substantially parallel positions. The components 64 may be any of a variety of form ties known in the art of concrete forming; ties 64 may be rigid wires extending perpendicularly through both forms 54, 55 and featuring small disk or cone-shaped elements (not shown) in contact with the inner and/or outer faces of each form, thereby preventing the forms 54 or 55 from shifting inward or outward relative to the form space 56. As seen in FIG. 2, the outside face 67 of each form 54, 55 may feature a grid of reinforcing elements to strengthen the form against failure while the rammed earth wall is being erected. Forms 54, 55 preferably are provided with exterior supports and braces 34 (FIGS. 1, 5 and 6) to maintain their verticality during the erection of the wall. Again, traditional forms used in the pouring and forming of reinforced concrete walls may readily be adapted for the practicing of the present method of rammed earth construction.

FIGS. 1 and 2 also show that form inserts 25 may be installed between the forms 54, 55 to provide for openings in the rammed earth wall. An insert 25 may be crafted from wood or any other suitable rigid material, and essentially comprises a framework for creating a void in the rammed earth wall to serve as a door, window, duct, or the like, through the wall. The insert 25 is constructed or placed within the form space 56 between the parallel main forms 54, 55. The form insert 25 is shaped to define the outline of the desired wall opening, and occupies space that would otherwise be filled with rammed earth. After the rammed earth is disposed between the forms according to the method, and after the main forms 54, 55 are removed, the framework insert 25 also is removed to leave the opening of desired size and shape through the rammed earth portion of the wall. In the method a strong structural lentil (not shown) must be provided above any opening in the wall, as known in the art. The configuration, composition, and use of form inserts 25 in the method is generally in accordance with known methods and materials borrowed from the art of erecting rammed earth or reinforced concrete walls.

Figure 3A:
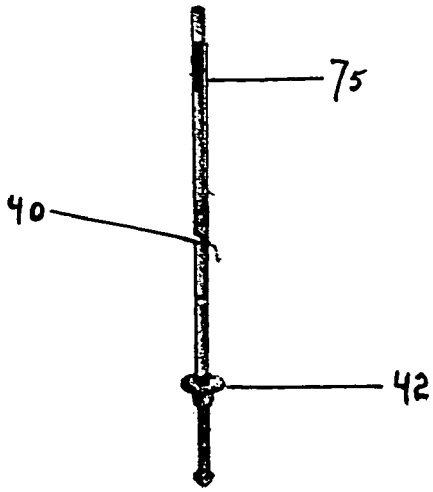
FIG. 3A is a perspective view from above of a post-tensioning rod according to the present invention.
Figure 3B:
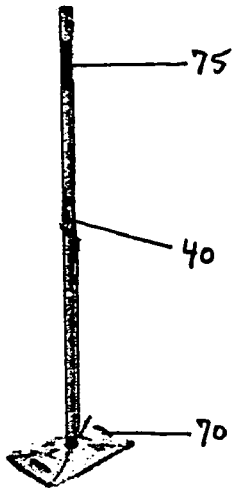
FIG. 3B is a perspective view similar to that of FIG. 3A, illustrating an alternative embodiment of a post-tensioning rod useable in the present invention.
Figure 3C:
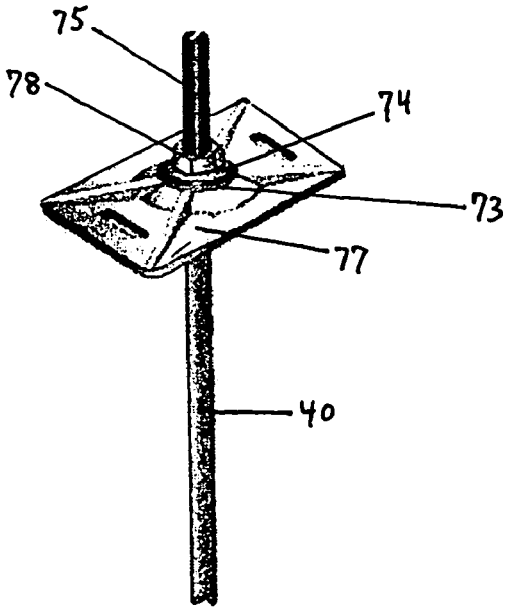
FIG. 3C is an enlarged perspective view from above of a collection of components used in connection with an upper terminus of post tension rod according to the practice of the present invention.

FIGS. 3A–C depict aspects of a tension rod 40 according to the present apparatus and method. The tension rod 40 may be a single integral length, or may have segments that are connectable together at their ends, as by threaded screw connections. As seen in FIG. 3A, at or near the bottom end of a tension rod 40 is a tension rod retainer cap 42. The cap 42 is fixedly attached to the tension rod 40. The retainer cap 42 is intended t be encased within concrete, e.g., a concrete footing 30, to prevent the tension rod 40 from being extracted longitudinally from the cured concrete. When the tension rod 40 is placed in tension, the cap 42 is not readily pulled through a concrete footing. The combination of the cap 42 and the mechanical bond between the concrete and the tension rod 40 serves to anchor the bottom end of the rod to the footing 30.

In an alternative embodiment seen in FIG. 3B, a bottom retainer plate 70 is fixedly attached to the lower end of the rod 40, rather than a retainer cap 42. The bottom retainer plate 70 serves the same purpose as the retainer cap 42 described immediately above.

FIG. 3C is an enlarged view of the top of a tension rod 40, showing elements used to post-tension the rod 40 according to the present apparatus and method. Near the top end of the tension rod 40 there is provided a threaded segment 75, along which screw-like threads are defined. The spiral threads of the segment 75 permit a tensioning nut 78 to be screwed down the length thereof, so that the nut can be tightened by rotation.

Figure 8:
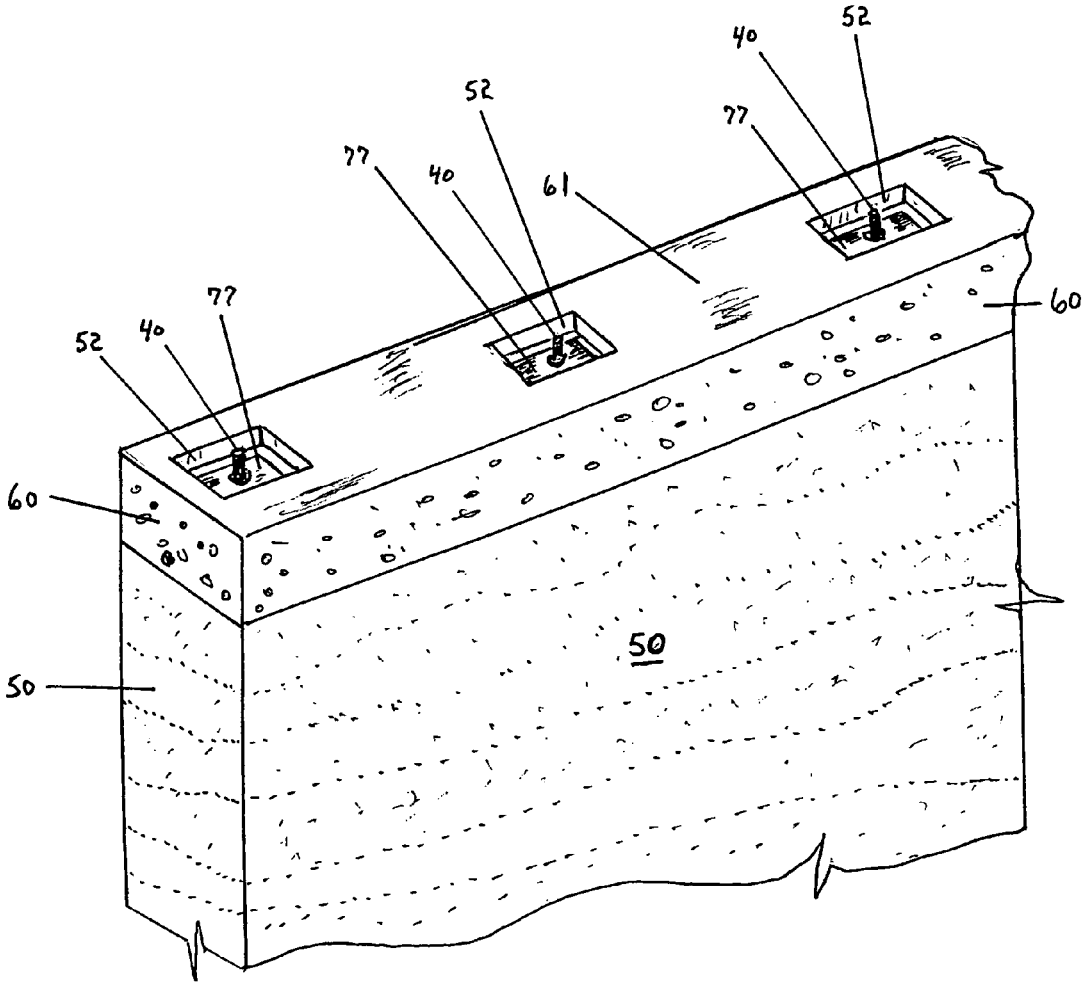
FIG. 8 is an enlarged perspective view, from above, illustrating the top surface of the beam placed upon the rammed earth portion of a completed wall, and the upper elements of the of the post-tensioning systems emergent in recessed pockets defined in the top of the beam.

Still referring to FIG. 3C, there is seen a retainer plate 77 and tensioning nut 78. The retainer plate 77 and tensioning nut 78 may be those known or adapted from in the art of post-stressed concrete construction techniques. A central hole 73 penetrates the retainer plate; the top end of the tension rod can be passed through the plate's central hole 73 permitting the retainer plate to be placed over and around the tension rod 40. The retainer plate 77 has a substantially flat underside surface that is placed in flush contact with the top of the bond beam 60 (as best seen in FIG. 8). The tensioning nut 78 has a screwed engagement with the threaded segment 75 of the upper most portion of the tension rod 40. The threads of the tensioning nut 78 and threaded portion 75 are configured such that the tightening of the tensioning nut 78 advances the tensioning nut down the threaded portion 77 of the tension rod 40, toward the retainer plate 77.

The tension rod 40 extends through the bond beam 60, and the retainer plate is disposed over the top end of the tension rod (with the rod passing through the central hole 73) and slipped down the rod past the threaded segment 75 thereof until the plate 77 rests upon the top of the bond beam 60. As best seen in FIG. 3C, a specialized washer 74, which also may be borrowed from the art of post-stressed concrete systems, also is slipped over and down the tension rod to rest upon the top of the retainer plate 77. The tensioning nut 78 is screwed down the threaded segment 75 of the tension rod, and torqued to tighten against the washer 74. Continued turning of the tensioning nut 78 thus causes the retainer plate 77 to press against the top of the bond beam 60 (FIG. 8). By these operations is the tension rod 40 placed in tension between its anchor with the footing 30 and the retainer plate 77, thereby to compress the rammed earth portion 50 of the wall between the bond beam 60 and the footing 30 (see also FIG. 7).

Figure 4:
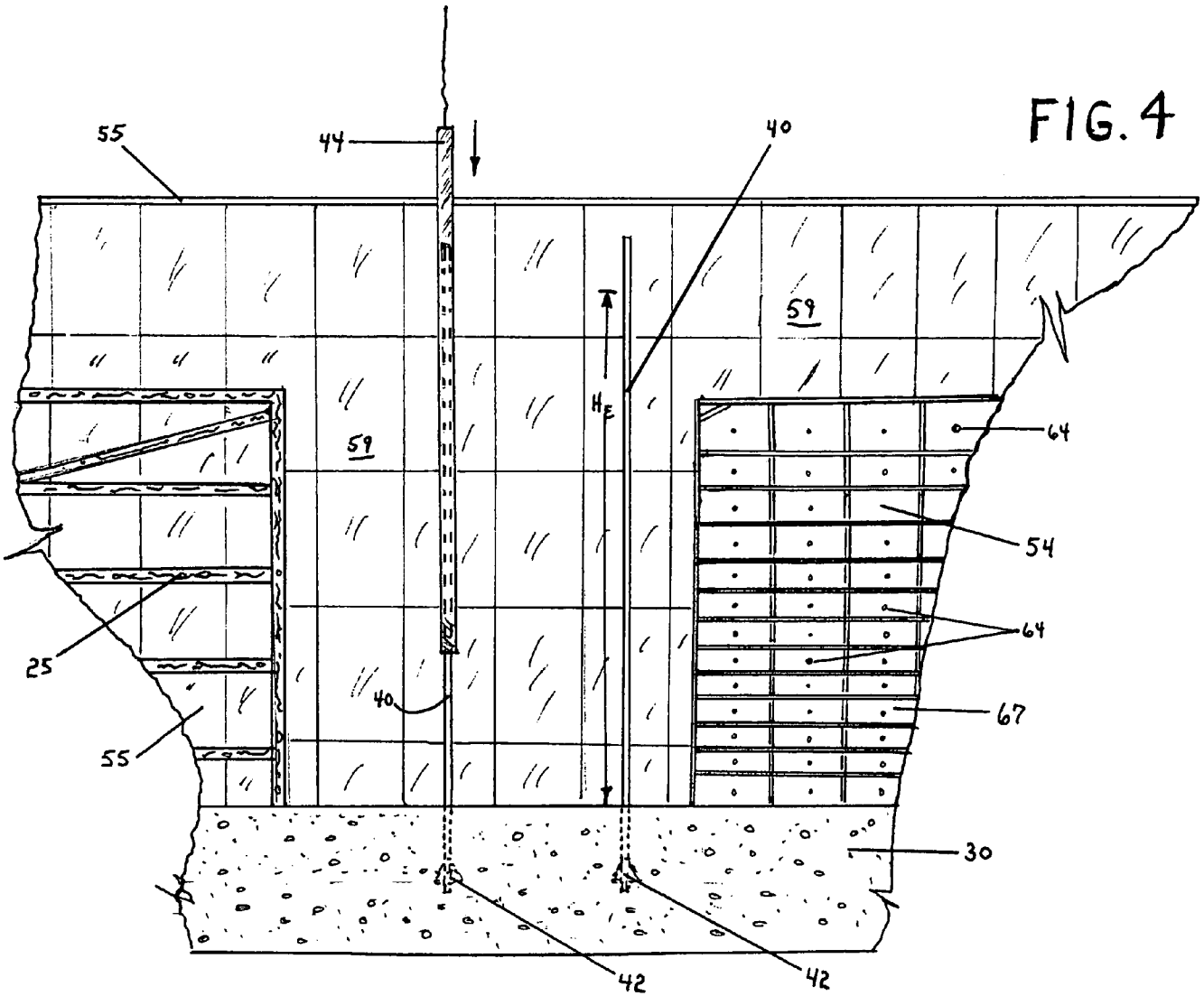
FIG. 4 is a front view, in partial section, similar to FIG. 2, illustrating the placement of a sleeve over one of the post tension bars in an embodiment of the present invention.

An advantage of the present method is that the tension rods 40 are shielded from contact with the rammed earth mixture (e.g., element 50 in FIG. 7). Inert sleeves 44 are provided over the tension rods 40 before the rammed earth mixture is deposited in the forms. FIG. 4 illustrates an inert sleeve 44 being placed over one of the tension rods 40. In the preferred embodiment, the inert sleeve is a length of PVC pipe, although alternative types of conduit or pipe having a relatively smooth exterior may also be deployed. The PVC pipe sleeve of the preferred embodiment has an inside diameter at least slightly greater than the outside diameter of the tension rod 40. So, as seen in FIG. 4, a length of PVC pipe sleeve 44 may be lowered down, over and around the tension bar 40, thereby to surround it. The inert sleeve 44 preferably has a length somewhat less than the length of the tension bar 40 projecting above the footing 30. The sleeve 44 is lowered along the tension bar 44 until its bottom end rests upon the top of the footing 30. The installed sleeve 44 rests directly upon the footing 30. The top end of the sleeve 44 preferably attains a height HE (a dimension shown in FIGS. 4, 6 and 7) that is about the height of the rammed earth portion of the wall, which also is the elevation of the bottom of a bond beam 60 (FIG. 6) that is placed on the rammed earth part of the wall. An inert sleeve 44 preferably is provided around every tension rod 40 in the structure.

The inert sleeves 44 prevent the rammed earth from directly contacting the tension rods 40. This separation between rammed earth and tension rod 40 serves two desirable objects. First, it prevents the creation of a mechanical bond between the rammed earth and the tension rod 40 which may interfere with the post-tensioning action of the rod. The rod 40 is free to shift longitudinally within the inert sleeve 44. Additionally, the sleeve 44 provides protection for the tension rod 40 against the potentially corroding effects of the rammed earth. Providing an inert sleeve around the tension rod 40 reduces or eliminates the potential for the tension rod 40 to degrade chemically and/or physically within the completed wall.

Figure 5:
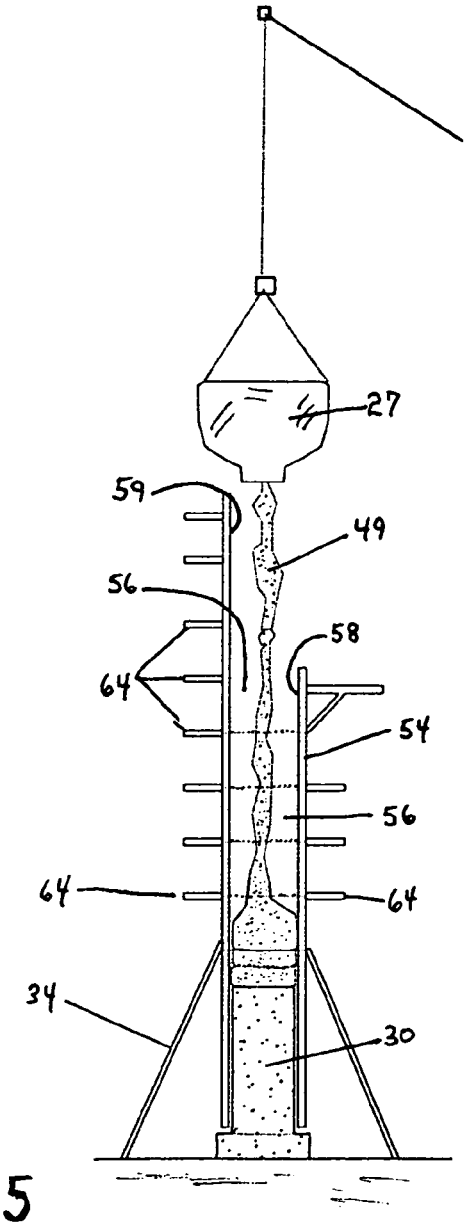
FIG. 5 is a right side or end sectional view, similar to FIG. 1, of a formwork and footing according to the practice of this disclosure, showing the use of an overhead drop bucket for placement of earth mixture between the forms and upon the footing, where the mixture will be compressed or "rammed" in accordance with the present method.

Reference is made to FIG. 5. Following installation of the inert sleeves 44 upon the tension rods 40, the rammed earth mixture 49 is disposed into the form space 56 between the forms 54, 55 generally according to standard rammed-earth construction procedures. In one preferred method, the rammed earth is mixed at the job site and the mixture 49 placed in a dump bucket 27 at the end of the working line of a pivotal overhead crane. The dump bucket 27 is actuated to drop pour the earthen mixture 49 into the form space 56, as seen in FIG. 5. The earthen mix 49 thus may be placed in batches to create layers of earth to form the wall.

The earthen material 49 is mixed according to engineering principles known in the art of rammed earth construction. The mix may be, for example, a combination of about 90% native soil and 10% Portland cement, with water added to create a friable mixture. A more sophisticated engineered mixture includes about 10% native soil, approximately 10% Portland cement, and about 80% crusher fines, again with a very modest percentage of water added. Other mixtures are known in the art. The earthen mixture is mixed at or near the site, and immediately disposed into the form space 56.

Figure 6:
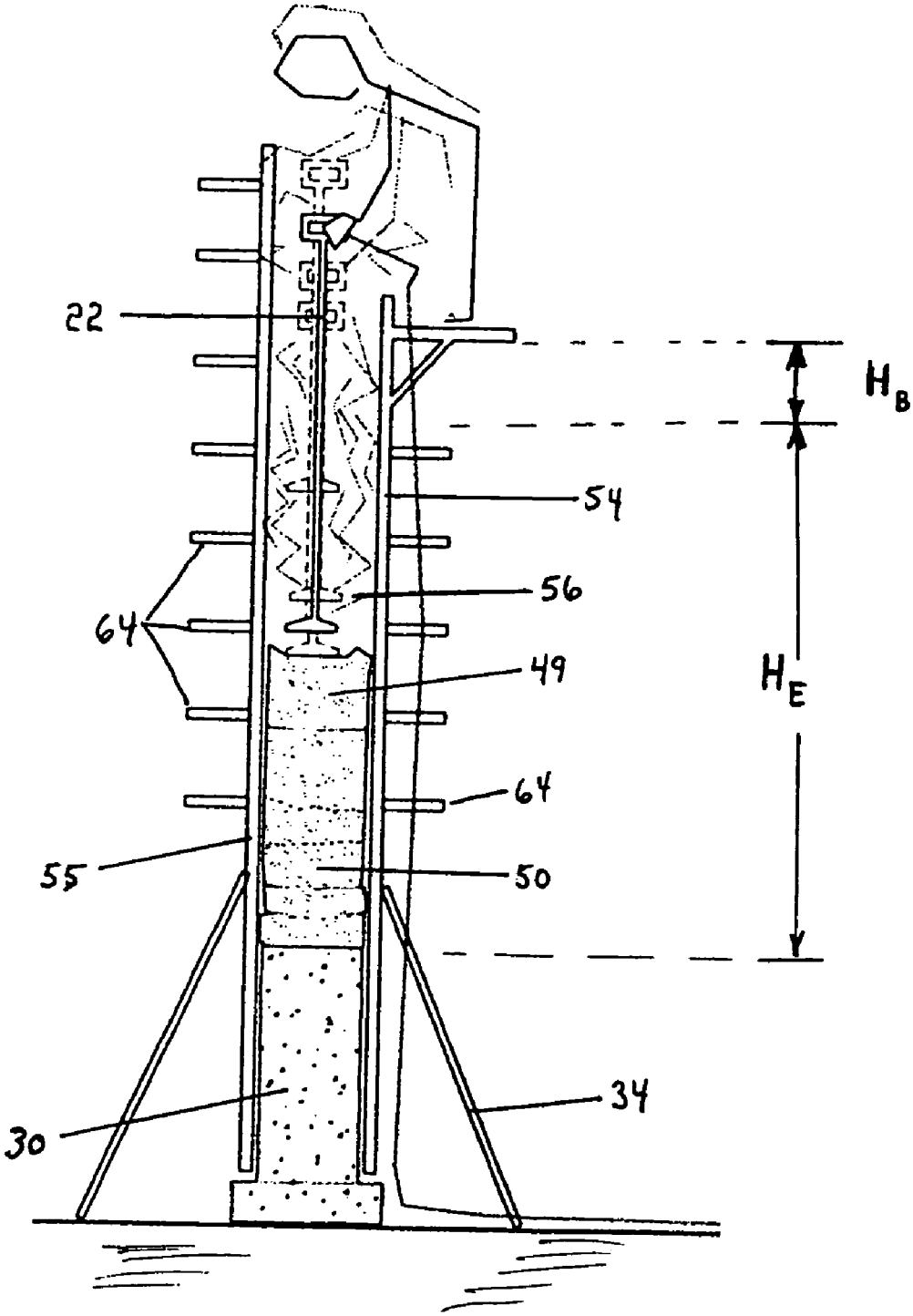
FIG. 6 is a side view showing the compaction of successive courses or lifts of earthen mixture into the space between the forms.

Reference is made to FIG. 6. The earthen mixture 49 is deposited between the forms 54, 55, the first batch directly upon the top of the footing 30, and successive batches upon previous depositions. The earthen mixture 49 is disposed in successive courses or "lifts" approximately 10 to 12 inches in height. As seen in FIG. 6, upon the placement of a complete lift, the mixture is pneumatically or manually compacted until the point of refusal is reached. This "rammed" compaction preferably is done with a pneumatic compactor, but in remote areas may be accomplished manually with a long tamper tool 22. FIG. 3C shows the compactor tool 22 in both solid and phantom lines, illustrating the rapidly repeated up-and-down motion of the tool 22 that compacts the earthen mixture 49 in the uppermost lift, disposed upon the rammed earth portion 50 of the wall being erected. Proper compaction may be done following audible clues, as the sound of tamping changes as compaction proceeds. It also is possible to visually distinguish when the mixture refuses further compression. A 12-inch lift of earthen mixture 49 may compact, for example to a layer of rammed earth 6–8 inches thick (in height). Exterior supports 34 and form ties 64 prevent the forms 54, 55 from breakout during compaction of the earthen mixture.

Upon complete compaction of a particular layer of rammed earth, the next lift is deposited upon the previous, compacted layer, and the process repeated. Subsequent lifts are placed until the entire height $H_E$ of the rammed earth portion 50 of the wall is achieved, and the form space 56 is substantially filled. But as suggested in FIG. 6, a modest height $H_B$ of form space 56 at the tops of the forms 54, 55 is left unfilled by rammed earth, to permit a bond beam 60 to be placed in the upper reach of the form space, as indicated in FIGS. 7 and 8.

Thus, earthen mixture 49 is disposed into the form space 56 to a predetermined height (e.g., providing for a thickness of around 12 inches), and then is compacted in a first course of perhaps about 8 inches in thickness. Additional earthen mixture 49 is disposed into the form space 56, upon the compacted first course, to another second predetermined height (again accounting for an uncompacted course or lift of around 12 inches) and compacting the earthen mixture in the second course of, for example, about 8 inches. The immediately preceding step is repeated a number of times to lay up a wall 50 of compacted earthen mixture in a number of packed courses.

The topmost surface of the rammed earth portion 50 of a completed wall preferably is very level and horizontal in relation to the ground. The rammed earth portion 50 of the wall preferably does not reach the top edges of the forms 54, 55. The top surface of the rammed earth portion 50 of the wall is below the tops of the forms 54, 55 a height distance $H_B$ approximately equal to the height thickness of a bond beam 60 to be placed upon the top of the wall.

FIGS. 7 and 8 illustrate that a bond beam 60 is placed upon the top of the rammed earth portion 50 of the wall. The bond beam 60 preferably is a reinforced concrete beam; the concrete mix is poured into the remaining unoccupied form space 56 defined above the top of the rammed earth portion 50 of the wall, and between the top portions of the forms 54, 55. Thus, the rammed earth 50 and the forms 54, 55 provide the forms for the concrete bond beam, which is poured to a strike-off level corresponding to the top edges of the main forms. Notably, the upper segments of the tension rods 40 extend through the bond beam 60, leaving a length of at least a few inches of tension rod projecting above the top surface of the bond beam 60.

Referring specifically to FIG. 8, it is seen that the bond beam 60 preferably is formed and molded to provide pockets 52 at the locations where top ends of the tension rods 40 protrude through the beam 60. The pockets 52 allow the retainer plates 77 and the top ends of the tension rods 40 to situate below the upper surface 61 of the beam. The retainer plates 77 rest upon the flat bottoms of the pockets 52 molded in the beam 60 at the time it is poured. The entirety of the plates 77 and their associated washers 74 and tensioning nuts 78, as well as the upper terminus of each rod 40 are within the void of the corresponding pocket 52. After the tension rods 40 have been placed into tension by the tightening of the tensioning nuts 78 according the inventive method, the pockets 52 preferably are filled with grout (not shown) which is smoothed flush with the top surface of the beam 60. The upper termini of the rods 40, the retainer plates 77 and nuts 78 and washers 74, are thus recessed in the grouted pockets of the completed beam 60 to allow unobstructed placement of roof systems (FIG. 7) on the upper surface 61 of the beam 60, and to protect the tensioning elements from deterioration from weather, etc.

As suggested by FIG. 8, the bond beam 60 as it cures forms a bond with the top of the rammed earth portion 50 of the wall. The bond beam 60 is engineered in size and reinforcement according to standard principles of structural design based on engineering data.

Combined reference is made to FIGS. 3C, 7 and 8. Once the bond beam 60 concrete has been placed and adequately cured, the retaining plate 77 is slipped down the top portion of each tension rod 40 and into a corresponding pocket 52. The retainer plate 77 is upon the threaded segment 75 of the rod 40. The retainer washer 74 is placed around each tension rod and over the corresponding retainer plate 77. A tensioning nut 78 is screwed down the threaded segment 75 of each tension rod 40, and tightened down against the associated retainer washer 74. Each tensioning nut 78 is turned to screwably advance along the associated tension rod 40, thereby pressing the washer 74 against the retainer plate 77, which in turn forcibly pushes against the top surface of the bond beam 60.

The tensioning nuts 78 then are torqued to a predetermined amount (i.e., a specified ft-lb of torque) to generate tension in the tension rod 40. The generation of large tensile forces in the tension rod 40 develops a specific compressive load on the retainer plate 77. Such loading is determined according to principles known to one of skill in the art. The resulting pressure of the retainer plates 77 against the bond beam 60 causes the bond beam to push against the top of the rammed earth portion 50 of the wall. The rammed earth 50 is subjected to a substantial constant compressive load consequent to the tension vectors in the rods 40. The tensioning nuts 78 are torqued to the predetermined amount, and may then be secured in place (e.g., by epoxy) to prevent their inadvertent loosening over time. Because the rammed earth 50 wall along its horizontal length thereafter is subject to constant, vertically applied, compressive forces, its tendency to fail under laterally applied external forces is reduced appreciably.

Once the entire wall is set and torqued to the proper engineering specifications, the pockets 52 remaining from the placement of the retainer plates 77 are then grouted and struck-flush with the top surface of the bond beam 60. All subsequent roof structures (e.g., rafters 80, 82) are then anchored to the bond beam 60, thus tying the overall roof system to the rammed earth walls, which creates the lateral resistance to applied and inertial forces, increasing the ability of the wall to be displaced laterally without failing in tension.

FIG. 7 is a perspective sectional view of a structural wall element completed according to the practice of the present method. The lower portion of the structure is the footing 30 fashioned from engineered concrete reinforced with rebar 32 in quantities, sizes, and arrangements (vertical and horizontal) according to known principles of structural engineering. The footing 30 also is shaped and sized generally according to known principles, and usually, but not necessarily, is beneath the finished grade at the construction site. The courses of rammed earth 50 (in FIG. 7, fourteen courses of compaction are visible) at the desired thickness established by the form spacing are seen erected to the predetermined height $H_E$. The concrete bond beam 60 is seen disposed horizontally upon and in direct contact with the top of the rammed earth 50 portion of the wall. The bond beam 60 has lengths of steel rebar 62 (four horizontal bars seen in FIG. 7) according to known engineering.

A pair of structural roof beams 80, 82 are shown resting upon and are secured to the beam 60 (as with grouted bolts (not shown in FIG. 7) emerging from the top of the beam). The plurality of roof beams or rafters 80, 82 may be arrayed generally perpendicular to the plane of the wall, according to convention, and may overhang the wall to provide for a roof eve, also as known in the art. The beams 80, 82 may provide for a flat roof, or may be inclined according to convention to provide for a pitched roof. The roof beams may be steel or engineered wood I-beams, wooden beams, or otherwise according to the engineering requirements of the roof and local availability of materials.

FIG. 7 shows that the lower ends of the tension rods 40 are fitted with the retainer caps 42, the caps and a lower segment of each rod being encased within the cured concrete of the footing 30. Surrounding each rod 40 and extending from the top of the footing 30 to a point just beneath the bond beam 60 is the inert sleeve 44 separating the tension rod from the rammed earth 50. An upper segment of each tension rod 40 extends upward through the bond beam 60; the retainer plate 77 and tensioning nut 78 being at (or preferably just below) the top surface of the bond beam 60 as described herein above.

The method of this application is apparent from the foregoing, but may be summarized. This is a method of erecting a rammed earth structural element having improved load bearing capabilities. The basic steps of the process are the laying of a footing 30 and the arranging of a pair of forms 54, 55 substantially vertically on the footing 30, the forms being placed in spaced-apart relation to define a form space 56 there-between. At least one tension rod 40 is oriented vertically in the form space 56 and anchoring a lower end of the tension rod 40 to the footing 30. This is followed by disposing earthen mixture 49 into the form space 56 to a predetermined height, i.e., the selected height of one course or "lift" of material, and the compacting of the earthen mixture in the first course, and then disposing additional earthen mixture into the form space 56, and upon the first course, to another predetermined height (taking in to consideration the desired thickness of the second course) and compacting the earthen mixture in the second course. This process is repeated a number of times to lay up a wall of compacted earthen mixture 50, followed by placing a beam 60 upon a top of the wall with the at least one tension rod 40 having an upper end extending vertically through the top of the beam 60. Finally, tension is generated in the at least one tension rod 40 thereby to compress the rammed earth wall 50 between the beam 60 and the footing 30.

The foregoing apparatuses and processes are disclosed for the erection of an exemplary wall element. Persons of ordinary skill in the art will immediately appreciate that such wall elements can be arranged and conjoined to form both interior and exterior walls of a structure. Further, the walls can be placed in such arrays and configuration to permit a "box" enclosure according to usual modes of construction architecture, to realize the erection of residential and commercial buildings.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of erecting a rammed earth structural element having improved load bearing capabilities, comprising the steps of:

laying a footing;

arranging a pair of forms substantially vertically on the footing, the forms being placed in spaced-apart relation to define a form space there-between;

orienting at least one tension rod vertically in the form space and anchoring a lower end of the tension rod to the footing;

disposing earthen mixture into the form space to a predetermined height and compacting the earthen mixture in a first course;

disposing additional earthen mixture into the form space, and upon the first course, to another predetermined height and compacting the earthen mixture in a second course;

repeating the immediately preceding step a number of times to lay up a wall of compacted earthen mixture;

placing a beam upon a top of the compacted earthen wall with the at least one tension rod having an upper end extending vertically through the top of the beam; and generating tension in the at least one tension rod thereby to compress the compacted earthen wall between the beam and the footing.

2. A method according to claim 1 wherein the step of laying a footing comprises pouring a reinforced concrete footing.

3. A method according to claim 2 wherein the step of anchoring a lower end of the tension rod comprises situating the lower end of the tension rod within the concrete footing while the footing is poured.

4. A method according to claim 1 wherein the step of arranging a pair of forms comprises:

erecting forms on both sides of the footing, the forms having generally parallel planar inner faces separated by a predetermined distance corresponding to a desired thickness of the wall; and interconnecting the parallel forms with components that hold the forms substantially parallel.

5. A method according to claim 4 wherein the step of interconnecting the forms comprises installing tie elements generally perpendicular through the forms.

6. A method according to claim 1 comprising the further step of providing a sleeve around said at least one tension rod.

7. A method according to claim 6 wherein providing a sleeve comprises slipping plastic conduit over the tension rod.

8. A method according to claim 1 wherein the step of placing a beam comprises pouring a concrete beam upon a top surface of the compacted earthen wall.

9. A method according to claim 7 comprising the further step of reinforcing the beam with a steel bar.

10. A method according to claim 1 wherein the step of generating tension in the at least one tension rod comprises:

disposing a retainer plate around the upper end of the tension rod and against the top of the beam;

providing a threaded portion on the upper end of the tension rod in the vicinity of the retainer plate;

screwably engaging a nut about the threaded portion; and forcibly torquing the nut on the threaded portion, causing the nut to tighten against the retain plate, thereby pressing the retainer plate against the beam.

11. A method of erecting a rammed earth structural element having improved load bearing capabilities, comprising the steps of:

laying a footing;

arranging a pair of forms substantially vertically on the footing, the forms being placed in spaced-apart relation to define a form space there-between;

orienting at least one tension rod vertically in the form space and anchoring a lower end of the tension rod to the footing;

disposing earthen mixture into the form space to a predetermined height and compacting the earthen mixture in a first course;

disposing additional earthen mixture into the form space, and upon the first course, to another predetermined height and compacting the earthen mixture in a second course;

repeating the immediately preceding step a number of times to lay up a wall of compacted earthen mixture;

placing a beam upon a top of the wall with the at least one tension rod having an upper end extending vertically through the top of the beam; and generating tension in the at least one tension rod thereby to compress the wall between the beam and the footing, comprising:

disposing a retainer plate around the upper end of the tension rod and against the top of the beam;

providing a threaded portion on the upper end of the tension rod in the vicinity of the retainer plate;

screwably engaging a nut about the threaded portion; and forcibly torquing the nut on the threaded portion, causing the nut to tighten against the retain plate, thereby pressing the retainer plate against the beam.

12. A method according to claim 11 wherein the step of laying a footing comprises pouring a reinforced concrete footing.

13. A method according to claim 12 wherein the step of anchoring a lower end of the tension rod comprises situating the lower end of the tension rod within the concrete footing while the footing is poured.

14. A method according to claim 13 wherein the step of arranging a pair of forms comprises:

erecting forms on both sides of the footing, the forms having generally parallel inner planar faces separated by a predetermined distance corresponding to a desired thickness of the wall; and interconnecting the parallel forms with components that hold the forms substantially parallel.

15. A method according to claim 14 wherein the step of interconnecting the forms comprises installing tie elements generally perpendicular through the forms.

16. A method according to claim 15 further comprising the step of exteriorly supporting the forms in a vertical orientation.

17. A method according to claim 16 comprising the further step of slipping a plastic conduit over the tension rod.

18. A method according to claim 17 wherein the step of placing a beam comprises pouring a concrete beam upon the top surface of the wall.

19. A method according to claim 18 comprising the further step of reinforcing the beam with a steel bar.

20. A method according to claim 19 wherein generating a tension comprises the further steps of:

molding a pocket in the top surface of the beam at a location where the threaded portion of the tension rod extends therefrom;

placing the retainer plate and nut in the pocket prior to torquing the nut; and grouting the pocket after torquing the nut.

* * * * *